US008091693B2

(12) United States Patent
Della Valle et al.

(10) Patent No.: US 8,091,693 B2
(45) Date of Patent: Jan. 10, 2012

(54) METHOD AND PLANT FOR FILLING A HYDRAULIC CIRCUIT WITH A CONTROL FLUID

(75) Inventors: Antonio Della Valle, Monte San Pietro (IT); Andrea Zani, Bologna (IT); Alfredo Romano, Bologna (IT)

(73) Assignee: Magneti Marelli Powertrain S.p.A., Corbetta (IT)

( * ) Notice: Subject to any disclaimer, the term of this patent is extended or adjusted under 35 U.S.C. 154(b) by 1364 days.

(21) Appl. No.: 11/707,717

(22) Filed: Feb. 16, 2007

(65) Prior Publication Data

US 2007/0210646 A1 Sep. 13, 2007

(30) Foreign Application Priority Data

Feb. 17, 2006 (IT) ..... BO2006A0121

(51) Int. Cl.
*B65B 31/00* (2006.01)

(52) U.S. Cl. ..... 188/352; 141/65

(58) Field of Classification Search ..... 188/352; 141/59, 65, 98, 114

See application file for complete search history.

(56) References Cited

U.S. PATENT DOCUMENTS

| | | | | |
|---|---|---|---|---|
| 3,726,063 | A | 4/1973 | Magorien et al. | 55/194 |
| 4,017,329 | A * | 4/1977 | Larson | 134/21 |
| 4,959,960 | A | 10/1990 | LaFountain | 60/533 |
| 5,060,703 | A * | 10/1991 | Koerner | 141/59 |
| 5,653,316 | A * | 8/1997 | Kane | 188/352 |
| 6,536,486 | B2 * | 3/2003 | Erwin et al. | 141/65 |
| 6,796,339 | B1 * | 9/2004 | Petty | 141/65 |
| 2004/0040807 | A1 | 3/2004 | Burgdorf et al. | 188/352 |

FOREIGN PATENT DOCUMENTS

| | | |
|---|---|---|
| WO | WO 90/02083 | 3/1990 |
| WO | WO9002083 | 3/1990 |

OTHER PUBLICATIONS

Extended European Search Report dated Oct. 6, 2009 in the corresponding European Application No. 07102600.9.

* cited by examiner

*Primary Examiner* — Christopher Schwartz
(74) *Attorney, Agent, or Firm* — Ohlandt, Greeley, Ruggiero & Perle, L.L.P.

(57) ABSTRACT

A method and a plant for filling a hydraulic circuit with a control fluid, in which a vacuum is generated within the hydraulic circuit, the control fluid is supplied to a degasification chamber, a vacuum is generated in the degasification chamber containing the control fluid and the control fluid is supplied under pressure from the degasification chamber to the hydraulic circuit while continuing to maintain the vacuum in the hydraulic circuit.

24 Claims, 1 Drawing Sheet

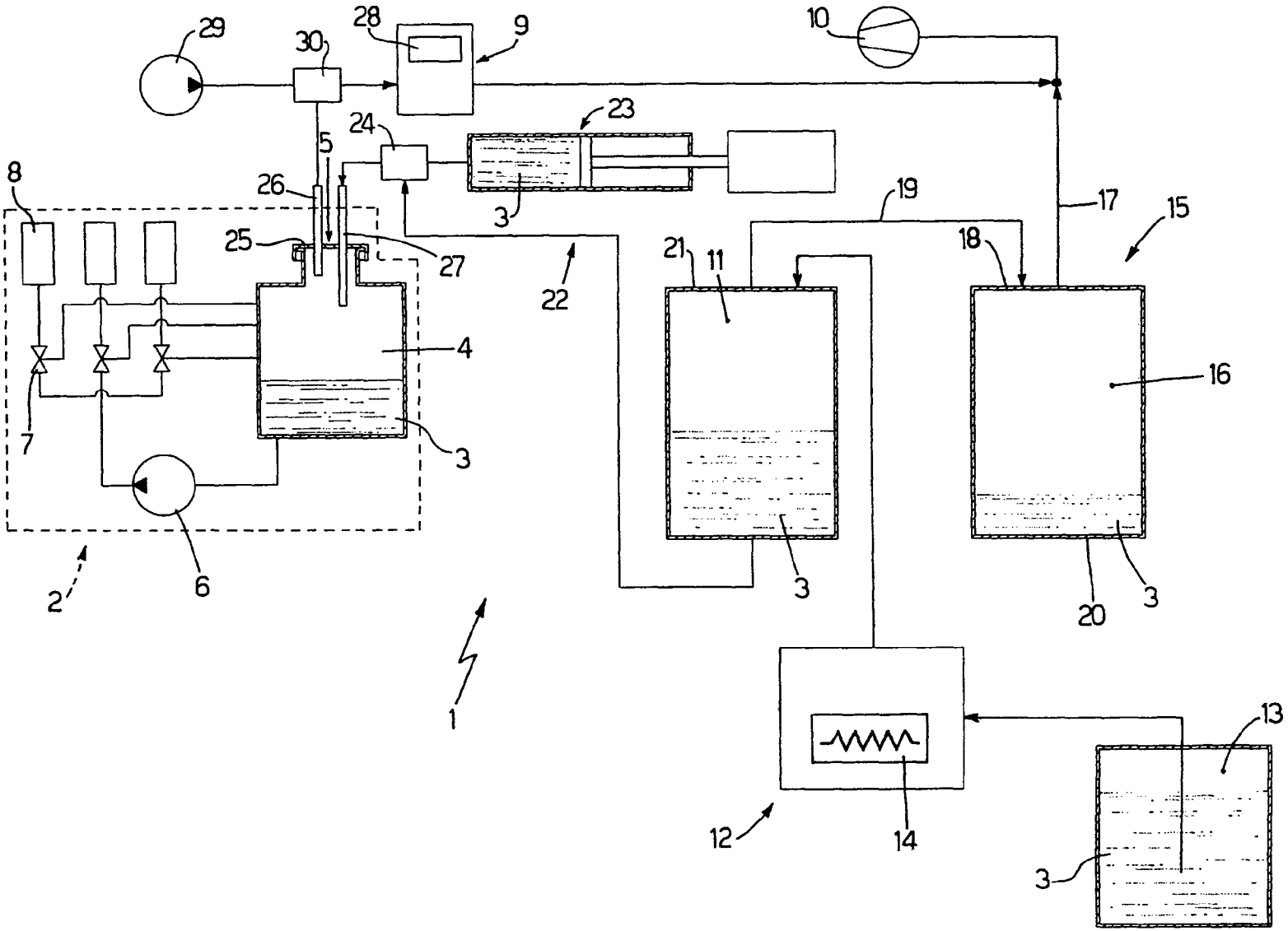
1
2
3
4
5
6
7
8
9
10
11
12
13
14
15
16
17
18
19
20
21
22
23
24
25
26
27
28
29
30

METHOD AND PLANT FOR FILLING A HYDRAULIC CIRCUIT WITH A CONTROL FLUID

The present invention relates to a method and a plant for filling a hydraulic circuit with a control fluid.

The present invention is advantageously applied to the filling of a hydraulic circuit of a drive device of a servo-assisted vehicle gear change, to which the following description will explicitly refer without thereby losing its general nature

BACKGROUND OF THE INVENTION

Servo-controlled gear changes, which are structurally similar to a manual gear change of the traditional type except for the fact that the clutch pedal and the gear selection lever actuated by the driver are replaced by corresponding electrical or hydraulic servo-controls, are becoming increasingly widespread. When using a servo-controlled gear change, the driver simply has to supply the instruction to change to a higher gear or to a lower gear to a transmission control unit and the transmission control unit independently changes gear by acting both on the engine and on the servo-controls associated with the gear change.

When hydraulic servo-controls are used, the drive device of the gear change comprises a hydraulic circuit provided with a tank for the oil forming the control fluid, a pump which pressurises the fluid, a series of electrovalves which receive the pressurised oil from the pump and discharge the oil to the tank, and a series of hydraulic actuators actuated by the electrovalves.

Once the drive device of the gear change has been completed and before the drive device is coupled to the gear change, the hydraulic circuit of the drive device is filled with the oil forming the control fluid. The filling of the hydraulic circuit involves supplying the oil to the tank until it reaches the predetermined level and then actuating the pump and the electrovalves to supply the oil throughout the hydraulic circuit.

A quantity of air, which is either in suspension in the oil or emulsified with the oil, is introduced into the hydraulic circuit when it is being filled. The presence of air in the hydraulic circuit modifies the behaviour of the electrovalves and in particular of the hydraulic actuators. When the hydraulic circuit contains an excessive amount of air, the drive device of the gear change is not able to guarantee nominal performance and does not therefore manage to carry out the gear changes correctly. Consequently, once the filling of the hydraulic circuit is complete, it is necessary to bleed the hydraulic circuit, i.e. to eliminate the surplus air from the hydraulic circuit.

At present, the bleeding of the hydraulic circuit takes place by actuating the drive device on the test bench for a very long period (up to 45 minutes). However, the bleeding method, as well as being very long, is not always efficient as it does not always make it possible to eliminate the air in the hydraulic circuit. When using the above-described method of bleeding, a high percentage of drive devices are therefore returned by customers because there is air in the hydraulic circuit. In particular, the above-described method of bleeding does not always make it possible to eliminate the air in the drive circuit as air bubbles may remain trapped in the interstices of the chambers and a substantial quantity of air may in particular remain emulsified with the oil.

WO9002083 discloses a method and an apparatus for filling a hydraulic brake system using nitrogen or dry air as a desiccant to assure freedom from moisture in brake fluid supplied from a supply tank as well as at the filling location. A main fluid tank has a vacuum over the fluid to deaerate the fluid and has a pump submerged in the fluid to deliver fluid to the brake system; the pump is driven by a submerged motor which is driven by pressurized brake fluid. The brake system is evacuated, the low pressure is monitored for a test interval for leak detection, the system is filled by the pump and excess fluid is returned to the main tank and is replaced by the nitrogen or dry air.

U.S. Pat. No. 3,726,063 discloses a system for removing contaminants such as dissolved and entrained gas, water and solids from fluids; contaminated fluid is atomized and filmed in a very low pressure vacuum to remove gas and water and filters are provided for removal of solids.

SUMMARY OF THE INVENTION

The object of the present invention is to provide a method and a plant for filling a hydraulic circuit with a control fluid, which method and plant are free from the drawbacks described above and are in particular easy and economic to embody.

In accordance with the present invention, a method and a plant for filling a hydraulic circuit with a control fluid are provided.

BRIEF DESCRIPTION OF DRAWING

The present invention will be described below with reference to the accompanying drawing which shows a non-limiting embodiment thereof. In particular, the accompanying FIGURE is a diagrammatic view of a plant for filling a hydraulic circuit with a control fluid embodied in accordance with the present invention.

DETAILED DESCRIPTION OF THE INVENTION

In the FIGURE, a plant for filling a hydraulic circuit 2 with a control fluid 3 (generally oil) for the hydraulic circuit 2 is shown overall by 1.

The hydraulic circuit 2 forms part of a drive device of a servo-assisted vehicle gear change and comprises a tank 4 provided with a charging opening 5 normally closed by a cap (not shown), a pump 6 to pressurise the control fluid 3, a number of electrovalves 7 which receive the pressurised control fluid 3 from the pump 6 and discharge the control fluid 3 to the tank 4, and a number of hydraulic actuators 8 driven by the electrovalves 7.

The filling plant 1 comprises a suction device 9 which is to generate a vacuum in the hydraulic circuit 2 and is connected to a vacuum pump 10.

The filling plant 1 further comprises a degasification chamber 11 which is adapted to contain a quantity of control fluid 3 greater than the quantity of control fluid 3 needed to fill the hydraulic circuit 2. A supply device 12 is provided with a charging pump (not shown) actuated electrically in order to supply the control fluid 3 from a container 13 to the degasification chamber 11. The charging pump is preferably coupled to a 2.5 micron filter member which has to be replaced periodically.

According to a preferred embodiment, the supply device 12 is provided with an electric heater 14 to heat the control fluid 3 before the control fluid 3 is supplied to the degasification chamber 11.

A suction device 15 generates a vacuum in the degasification chamber 11 containing the control fluid 3. The suction device 15 is connected to the vacuum pump 10, which is shared by the suction device 9 and the suction device 15. The suction device 15 comprises a separation chamber 16 which is connected to the vacuum pump 10 and to the degasification chamber 11. The vacuum pump 10 is connected to the separation chamber 16 by a duct 17 which communicates through an upper wall 18 of the separation chamber 16. The separation chamber 16 is connected to the degasification chamber 11 by a duct 19 which originates via the upper wall 18 of the separation chamber 16 (as an alternative it could originate via a lower wall 20 of the separation chamber 16) and communicates via an upper wall 21 of the degasification chamber 11.

A supply device 22 supplies the control fluid 3 under pressure from the degasification chamber 11 to the hydraulic circuit 2. The supply device 22 comprises a pneumatic cylinder 23 which may be connected at will to the degasification chamber 11 and to the hydraulic circuit 2 by means of a valve 24.

Lastly, the filling plant 1 comprises a sealing cap 25 which may be applied to the charging opening 5 of the tank 4 of the hydraulic circuit 2 and is provided with a suction tube 26, a predetermined length of which is inserted into the tank 4, connected to the suction device 22, and a supply tube 27, a predetermined length of which is inserted into the tank 4, connected to the suction device 9. The length of the supply tube 27 inserted into the tank 4 is preferably greater than the length of the suction tube 26; this prevents the control fluid 3 supplied via the supply tube 27 from being partially suctioned through the suction tube 26.

According to a preferred embodiment, the suction device 9 is provided with a control member 28 to carry out a test of the leak-tightness of the hydraulic circuit 2.

According to a preferred embodiment, the filling plant 1 comprises a pressuriser device 29 which is adapted to pressurise the hydraulic circuit 2 before the vacuum is generated in the hydraulic circuit 2. For instance, the pressuriser device 29 could be connected to the hydraulic circuit 2 as an alternative to the suction device 9 by means of a valve 30 (as shown in the accompanying FIGURE), or could be connected to the hydraulic circuit 2 independently from the suction device 9.

The operation of the filling plant 1 is described below.

The empty hydraulic circuit 2, i.e. containing no control fluid 3, is initially coupled to the filling plant 1 and the cap 25 is inserted in a leak-tight manner on the charging opening 5 of the tank 4. At this point, the bleed screws (known and not shown) of the hydraulic circuit 2 are opened.

Before starting to fill the hydraulic circuit 2, the hydraulic circuit 2 is pressurised using the pressuriser device 29 for a predetermined period of time so as to balance the inner seals (not shown) of the hydraulic circuit 2. By way of example, the hydraulic circuit 2 may be pressurised to a pressure of 1 bar for a period of 10 seconds.

Once the pressurisation of the hydraulic circuit 2 is completed, the hydraulic circuit 2 is connected to the suction device 9 in order to generate a vacuum within the hydraulic circuit 2. By way of example, a vacuum of at least 2 mm of mercury absolute is generated in the hydraulic circuit 2 and the vacuum is maintained for a predetermined period of at least 300 seconds before the control fluid 3 is supplied to the hydraulic circuit 2.

According to a preferred embodiment, a test of the leak-tightness of the hydraulic circuit 2 is also carried out immediately after the vacuum has been generated in the hydraulic circuit 2 using the control member 28. It will be appreciated that the control fluid 3 is supplied to the hydraulic circuit 2 only if the hydraulic circuit 2 is effectively leak-tight, i.e. free from losses. By way of example, the test of the leak-tightness of the hydraulic circuit 2 checks whether the pressure differential is lower than 5 mm of mercury for a period of at least 10 seconds. During the leak-tightness test, the pump 6 and the electrovalves 7 of the hydraulic circuit 2 are actuated in order to check the leak-tightness of all the components of the hydraulic circuit 2.

At this point or in parallel with the generation of the vacuum within the hydraulic circuit 2, the degasification chamber 11 is filled with the hot control fluid 3 by means of the supply device 12. The control fluid 3 is preferably heated to a temperature of between 45° C. and 55° C. (typically approximately 50° C.) before being supplied to the degasification chamber 11.

Once the degasification chamber 11 has been filled, a vacuum is generated in the degasification chamber 11 by means of the suction device 15 and the vacuum is maintained for a predetermined period of time before the control fluid 3 is supplied to the hydraulic circuit 2. By way of example, a vacuum of at least 2 mm of mercury absolute is generated in the degasification chamber 11. At this step, a small quantity of control fluid 3 deposited on the lower wall 20 of the separation chamber 16 is always maintained within the separation chamber 16.

When the degasification of the fluid is compete, the control fluid 3 is supplied from the degasification chamber 11 to the pneumatic cylinder 23 and the control fluid 3 is then supplied under pressure from the pneumatic cylinder 23 to the hydraulic circuit 2 while continuing to generate the vacuum in the hydraulic circuit 2. In other words, the pressurised fluid 3 is supplied via the supply tube 27 to the hydraulic circuit 2 and at the same time suction is continuously carried out via the suction tube 26 in order to maintain the vacuum in the hydraulic circuit 2. By way of example, the control fluid 3 is supplied to the hydraulic circuit 2 at a pressure of 1 bar.

It will be appreciated from the above description that the supply of control fluid 3 from the degasification chamber 11 to the hydraulic circuit 2 involves connecting the pneumatic cylinder 23 to the degasification chamber 11, supplying the control fluid 3 from the degasification chamber 11 to the pneumatic cylinder 23, connecting the pneumatic cylinder 23 to the hydraulic circuit 2, and actuating the pneumatic cylinder 23 in order to supply the pressurised control fluid 3 to the hydraulic circuit 2.

According to a preferred embodiment, the supply of the control fluid 3 under pressure to the hydraulic circuit 2 involves cyclically alternating a supply period (ON cycle) with a non-supply period (OFF cycle). The duration of the supply periods is preferably equal to the duration of the non-supply periods. By way of example, a supply period and a non-supply period have a duration of 10 seconds.

According to a different embodiment, the duration of the supply periods differs from the duration of the non-supply periods. It will be appreciated that the suction through the suction tube 26 is always maintained during both the supply periods and the non-supply periods.

Once the filling of the hydraulic circuit 2 is complete, the cap 25 is removed from the charging opening 5 of the tank 4, the charging opening 5 is closed by a standard cap and the hydraulic circuit 2 is disconnected from the filling plant 1.

It is important to bear in mind that during the generation of the vacuum in the hydraulic circuit 2 and during the supply of the control fluid 3 to the hydraulic circuit 2, the pump 6 and the electrovalves 7 of the hydraulic circuit 2 are actuated in order to enable correct filling of all the members of the hydraulic circuit 2.

The filling plant 1 described above has many advantages, as it enables the hydraulic circuit 2 to be filled with oil without introducing significant quantities of air into the hydraulic circuit 2 at the same time; at the end of filling of the hydraulic circuit 2, it is not therefore necessary to carry out any operation to bleed the air and the hydraulic circuit 2 is ready for use.

Various experimental tests have shown that by eliminating the need for bleeding operations, the use of the filling plant 1 described above makes it possible drastically to reduce the time needed to bring the hydraulic circuit 2 into service; in particular, the time needed to bring the hydraulic circuit 2 into service is reduced from the 60-75 minutes required by conventional methods to only 18-20 minutes.

Moreover, various experimental tests have shown that the use of the filling plant 1 described above makes it possible to eliminate, in a particularly efficient manner, the presence of air within the hydraulic circuit 2 thereby reducing returns linked to the presence of air in the hydraulic circuit 2 by over 50%.

Lastly, the filling plant 1 described above is particularly compact and reliable and simple and economic to embody; its inclusion in the assembly line of the hydraulic circuit 2 does not therefore entail an appreciable increase in the costs of production of the hydraulic circuit 2.

It will be appreciated that as a result of the many advantages presented by the filling plant 1 described above, the filling plant 1 may be used to fill any type of hydraulic circuit 2.

The invention claimed is:

1. A method of filling a hydraulic circuit (2) with a control fluid (3), the hydraulic circuit (2) comprising a tank (4) provided with a charging opening (5), a pump (6) to pressurise the control fluid (3), a number of electrovalves (7) and a number of hydraulic actuators (8) driven by the electrovalves (7), the method comprising the steps of:

generating a vacuum within the hydraulic circuit (2);

supplying the control fluid (3) to a degasification chamber (11);

generating a vacuum in the degasification chamber (11) containing the control fluid (3); and supplying the control fluid (3) under pressure from the degasification chamber (11) to the hydraulic circuit (2);

the method is characterized in comprising the further step of continuing to maintain the vacuum in the hydraulic circuit (2) while supplying the control fluid (3) under pressure from the degasification chamber (11) to the hydraulic circuit (2).

2. A method as claimed in claim 1 and comprising the further step of heating the control fluid (3) before the control fluid (3) is supplied to the degasification chamber (11).

3. A method as claimed in claim 2, wherein the control fluid (3) is heated to a temperature of between 45° C. and 55° C. before it is supplied to the degasification chamber (11).

4. A method as claimed in claim 3, wherein the control fluid (3) is heated to a temperature of approximately 50° C. before it is supplied to the degasification chamber (11).

5. A method as claimed in claim 1 and comprising the further step of pressurising the hydraulic circuit (2) for a predetermined period of time before the vacuum is generated in the hydraulic circuit (2).

6. A method as claimed in claim 5, wherein the hydraulic circuit (2) is pressurised to a pressure of 1 bar for a period of 10 seconds.

7. A method as claimed in claim 1, wherein a vacuum of at least 2 mm of mercury absolute is generated in the degasification chamber (11).

8. A method as claimed in claim 1, wherein the vacuum in the degasification chamber (11) is maintained for a predetermined period of time before the control fluid (3) is supplied to the hydraulic circuit (2).

9. A method as claimed in claim 1, wherein a vacuum of at least 2 mm of mercury absolute is generated in the hydraulic circuit (2).

10. A method as claimed in 1, wherein the vacuum in the hydraulic circuit (2) is maintained for a predetermined period of time before the control fluid (3) is supplied to the hydraulic circuit (2).

11. A method as claimed in claim 10, wherein the vacuum in the hydraulic circuit (2) is maintained for at least 300 seconds before the control fluid (3) is supplied to the hydraulic circuit (2).

12. A method as claimed in claim 1 and comprising the further step of carrying out a test of the leak-tightness of the hydraulic circuit (2) after the step of generating the vacuum in the hydraulic circuit (2) and before supplying the control fluid (3) under pressure to the hydraulic circuit (2), the step of supplying the control fluid (3) under pressure to the hydraulic circuit (2) taking place only if the hydraulic circuit (2) is effectively leak-tight.

13. A method as claimed in claim 12, wherein the step of carrying out a test of the leak-tightness of the hydraulic circuit (2) involves checking whether the pressure differential is below 5 mm of mercury for a period of at least 10 seconds.

14. A method as claimed in claim 12, wherein the pump (6) and the electrovalves (7) of the hydraulic circuit (2) are actuated during the step of conducting a test of the leak-tightness of the hydraulic circuit (2).

15. A method as claimed in claim 1, wherein the step of supplying the control fluid (3) under pressure from the degasification chamber (11) to the hydraulic circuit (2) involves cyclically alternating a supply period with a non-supply period.

16. A method as claimed in claim 15, wherein the duration of the supply periods is equal to the duration of the non-supply periods.

17. A method as claimed in claim 16, wherein a supply period and a non-supply period have a duration of 10 seconds.

18. A method as claimed in claim 15, wherein the duration of the supply periods differs from the duration of the non-supply periods.

19. A method as claimed in claim 1, wherein the control fluid (3) is supplied to the hydraulic circuit (2) at a pressure of 1 bar.

20. A method as claimed in claim 1, wherein the step of supplying the control fluid (3) under pressure from the degasification chamber (11) to the hydraulic circuit (2) comprises the further steps of connecting a pneumatic cylinder (23) to the degasification chamber (11), supplying the control fluid (3) from the degasification chamber (11) to the pneumatic cylinder (23), connecting the pneumatic cylinder (23) to the hydraulic circuit (2), actuating the pneumatic cylinder (23) to supply the control fluid (3) under pressure to the hydraulic circuit (2).

21. A method as claimed in claim 1, wherein the step of supplying the control fluid (3) under pressure from the degasification chamber (11) to the hydraulic circuit (2) while continuing to generate the vacuum in the hydraulic circuit (2) comprises the further steps of applying a sealing cap (25) to the charging opening (5) of the tank (4) of the hydraulic circuit (2), the cap being provided with a first suction tube (26), a first predetermined length of which is inserted in the tank (4), and a second supply tube (27), a second predetermined length of which is inserted in the tank (4), suctioning via the first suction tube (26) by connecting the first suction tube (26) to a suction device (9), supplying the control fluid (3) under pressure via the second supply tube (27).

22. A method as claimed in claim 21, wherein a second length of the second supply tube (27) greater than the first length of the first suction tube (26) is inserted into the tank (4).

23. A method as claimed in claim 1, wherein the step of generating the vacuum in the degasification chamber (11) containing the control fluid (3) comprises the further steps of connecting a separation chamber (16) to a suction device, generating and maintaining a vacuum in the separation chamber (16), connecting the separation chamber (16) to the degasification chamber (11).

24. A method as claimed in claim 23, wherein the suction device is connected to the separation chamber (16) by a first duct (17) which communicates via an upper wall (18) of the separation chamber (16), the separation chamber (16) being connected to the degasification chamber (11) by means of a second duct (19) which originates via the upper wall (18) of the separation chamber (16) and communicates via an upper wall (21) of the degasification chamber (11), a small quantity of control fluid (3) deposited on the lower wall (20) of the separation chamber (16) always being maintained within the separation chamber (16).

* * * * *